US010452007B2

(12) United States Patent
Iesaki

(10) Patent No.: US 10,452,007 B2
(45) Date of Patent: Oct. 22, 2019

(54) IMAGE FORMING APPARATUS WHICH EXECUTES DIFFERENT MODES DEPENDING ON TEMPERATURE OF HEATING MEMBER

(71) Applicant: Brother Kogyo Kabushiki Kaisha, Nagoya-shi, Aichi-ken (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/935,327

(22) Filed: Mar. 26, 2018

(65) Prior Publication Data

US 2018/0284667 A1 Oct. 4, 2018

(30) Foreign Application Priority Data

Mar. 31, 2017 (JP) ..... 2017-071058

(51) Int. Cl.
*G03G 15/00* (2006.01)
*G03G 15/20* (2006.01)

(52) U.S. Cl.
CPC ..... *G03G 15/2039* (2013.01); *G03G 15/2028* (2013.01); *G03G 15/6511* (2013.01)

(58) Field of Classification Search
CPC ..... G03G 15/2039; G03G 15/2028; G03G 15/6511
See application file for complete search history.

(56) References Cited

U.S. PATENT DOCUMENTS 5,669,039 A 9/1997 Ohtsuka et al.
5,915,146 A 6/1999 Kusaka et al.
7,606,509 B2 * 10/2009 Yako ..... G03G 15/5029 399/68

FOREIGN PATENT DOCUMENTS

JP H05-80604 A 4/1993
JP H05-80605 A 4/1993
JP H05-80665 A 4/1993
JP H06-149103 A 5/1994
JP H06-186875 A 7/1994
JP 2012-220825 A 11/2012

* cited by examiner

*Primary Examiner* — David M. Gray
*Assistant Examiner* — Michael A Harrison
(74) *Attorney, Agent, or Firm* — Banner & Witcoff, Ltd.

(57) ABSTRACT

An image forming apparatus includes: a roller; a heating member heating a sheet conveyed by the roller; a temperature sensor outputting a signal depending on a temperature of an end region of the heating member; and a controller. The controller selectively executes a first mode and a second mode. In the first mode, the roller conveys the first sheet, and then conveys the second sheet at a first interval. In the second mode, the roller conveys the first sheet, and then conveys the second sheet at a second interval longer than the first interval. When the controller has determined that a first time has elapsed after starting continuous printing in the first mode, and when the controller has determined that the temperature of the end region of the heating member is higher than a first temperature, the controller changes the mode from the first mode to the second mode.

12 Claims, 10 Drawing Sheets

IMAGE FORMING APPARATUS WHICH EXECUTES DIFFERENT MODES DEPENDING ON TEMPERATURE OF HEATING MEMBER

CROSS REFERENCE TO RELATED APPLICATION

The present application claims priority from Japanese Patent Application No. 2017-071058 filed on Mar. 31, 2017, the disclosure of which is incorporated herein by reference in its entirety.

BACKGROUND

Field of the Invention

The present invention relates to an image forming apparatus.

Description of the Related Art

There is conventionally known an image forming apparatus including a fixing unit. For example, when the number of sheets subjected to fixing of the fixing unit has reached a predefined number, the image forming apparatus reduces the number of sheets to be fixed per unit time to prevent temperature of a portion of the fixing unit through which no sheet passes (non-paper passing portion) from excessively rising (see Japanese Patent Application Laid-open Publication No. H06-186875).

SUMMARY

An image forming apparatus according to the present teaching includes: a roller; a heating member; a temperature sensor; and a controller. The roller is configured to convey a sheet. The heating member is configured to heat the sheet conveyed by the roller. The heating member extends in a width direction orthogonal to a conveyance direction of the sheet. The temperature sensor is configured to output a signal depending on a temperature of an end of the heating member in the width direction. The controller is configured to control an operation of the roller. The controller selectively executes a first mode and a second mode in a case that the image forming apparatus executes continuous printing in which an image is formed on a second sheet continuously after an image is formed on a first sheet. In the first mode, the roller conveys the first sheet first, and then conveys the second sheet at a first interval. In the second mode, the roller conveys the first sheet first, and then conveys the second sheet at a second interval which is longer than the first interval.

In a case that the controller has determined that a first time has elapsed after the image forming apparatus starts the continuous printing in the first mode, and in a case that the controller has determined based on the signal from the temperature sensor that the temperature of the end of the heating member is higher than a first temperature, the controller executes the second mode.

DESCRIPTION OF THE EMBODIMENTS

<Outline of Image Forming Apparatus>

An outline of an image forming apparatus 1 is explained below.

Figure 1:
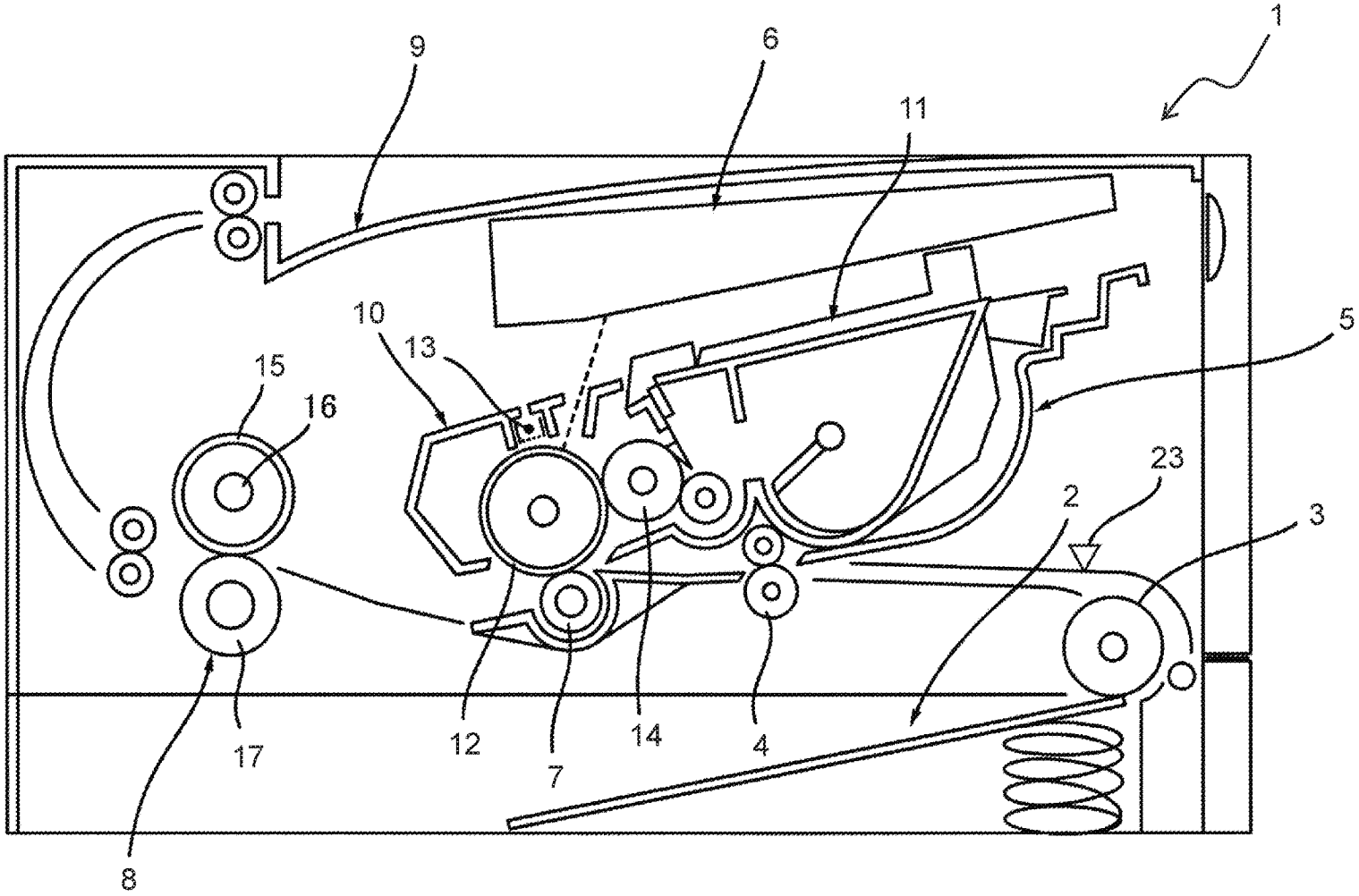
FIG. 1 schematically depicts a configuration of an image forming apparatus of the present teaching.

As depicted in FIG. 1, the image forming apparatus 1 includes a feed tray 2, a pickup roller 3 as an exemplary roller, a registration roller 4, a process cartridge 5, a laser scan unit 6, a transfer roller 7, a fixing unit 8, and a discharge tray 9.

<Feed Tray>

The feed tray 2 stores sheets. Specifically, the feed tray 2 stores sheets having a size determined in accordance with a specification of the image forming apparatus 1.

<Pickup Roller>

The pickup roller 3 conveys the sheet at predefined timing. Specifically, the pickup roller 3 conveys each sheet in the feed tray 2 toward a photosensitive drum 12 described later at the predefined timing. The pickup roller 3 is positioned above the feed tray 2.

<Registration Roller>

The registration roller 4 temporarily stops the sheet conveyed from the pickup roller 3 toward the photosensitive drum 12, and then conveys the sheet toward the photosensitive drum 12 at predefined timing. The registration roller 4 is positioned between the pickup roller 3 and the photosensitive drum 12 in a sheet conveyance direction.

<Process Cartridge>

The process cartridge 5 is removably installed to the image forming apparatus 1. The process cartridge 5 includes a drum cartridge 10 and a developing cartridge 11.

The drum cartridge 10 includes the photosensitive drum 12 and a charger 13.

The photosensitive drum 12 extends in a width direction orthogonal to the sheet conveyance direction. The photosensitive drum 12 can rotate around a shaft extending in the width direction. A toner image is formed on a surface of the photosensitive drum 12.

The charger 13 charges the surface of the photosensitive drum 12.

The developing cartridge 11 supplies toner to the surface of the photosensitive drum 12. The developing cartridge 11 contains the toner. The developing cartridge 11 includes the developing roller 14.

The developing roller 14 supplies the toner in the developing cartridge 11 to the surface of the photosensitive drum 12. The developing roller 14 is positioned on a downstream side of the charger 13 in a rotating direction of the photosensitive drum 12 while leaving a space between the developing roller 14 and the charger 13. The developing roller 14 is in contact with the photosensitive drum 12.

<Laser Scan Unit>

The laser scan unit 6 exposes the surface of the photosensitive drum 12. Specifically, the laser scan unit 6 exposes the surface of the photosensitive drum 12 on the downstream side of the charger 3 and on an upstream side of the developing roller 14 in the rotating direction of the photosensitive drum 12.

<Transfer Roller>

The transfer roller 7 transfers the toner image on the surface of the photosensitive drum 12 to the sheet when the sheet passes between the photosensitive drum 12 and the transfer roller 7. The transfer roller 7 is positioned on a downstream side of the developing roller 14 and on an upstream side of the charger 13 in the rotating direction of the photosensitive drum 12. The transfer roller 7 is in contact with the photosensitive drum 12.

<Fixing Unit>

The fixing unit 8 fixes the toner image transferred on the sheet to the sheet. The fixing unit 8 is positioned on a downstream side of the transfer roller 7 in the sheet conveyance direction while leaving a space between the fixing unit 8 and the transfer roller 7. The fixing unit 8 includes a heating roller 15 as an exemplary heating member, a halogen heater 16, and a pressure roller 17.

The heating roller 15 heats the sheet conveyed by the pickup roller 3. Specifically, the heating roller 15 heats the sheet having the toner image transferred thereon when the sheet passes between the heating roller 15 and the pressure roller 17. The heating roller 15 extends in the width direction.

The halogen heater 16 heats the heating roller 15. The halogen heater 16 is positioned in the heating roller 15. The halogen heater 16 extends in the width direction.

The pressure roller 17 applies pressure to the sheet having the toner image thereon when the sheet passes between the heating roller 15 and the pressure roller 17. The pressure roller 17 is in contact with the heating roller 15.

<Discharge Tray>

The sheet that passed through the fixing unit 8 is discharged on the discharge tray 9. The discharge tray 9 is positioned on a downstream side of the fixing unit 8 in the sheet conveyance direction.

<Details of Image Forming Apparatus>

Details of the image forming apparatus are explained below.

Figure 2:
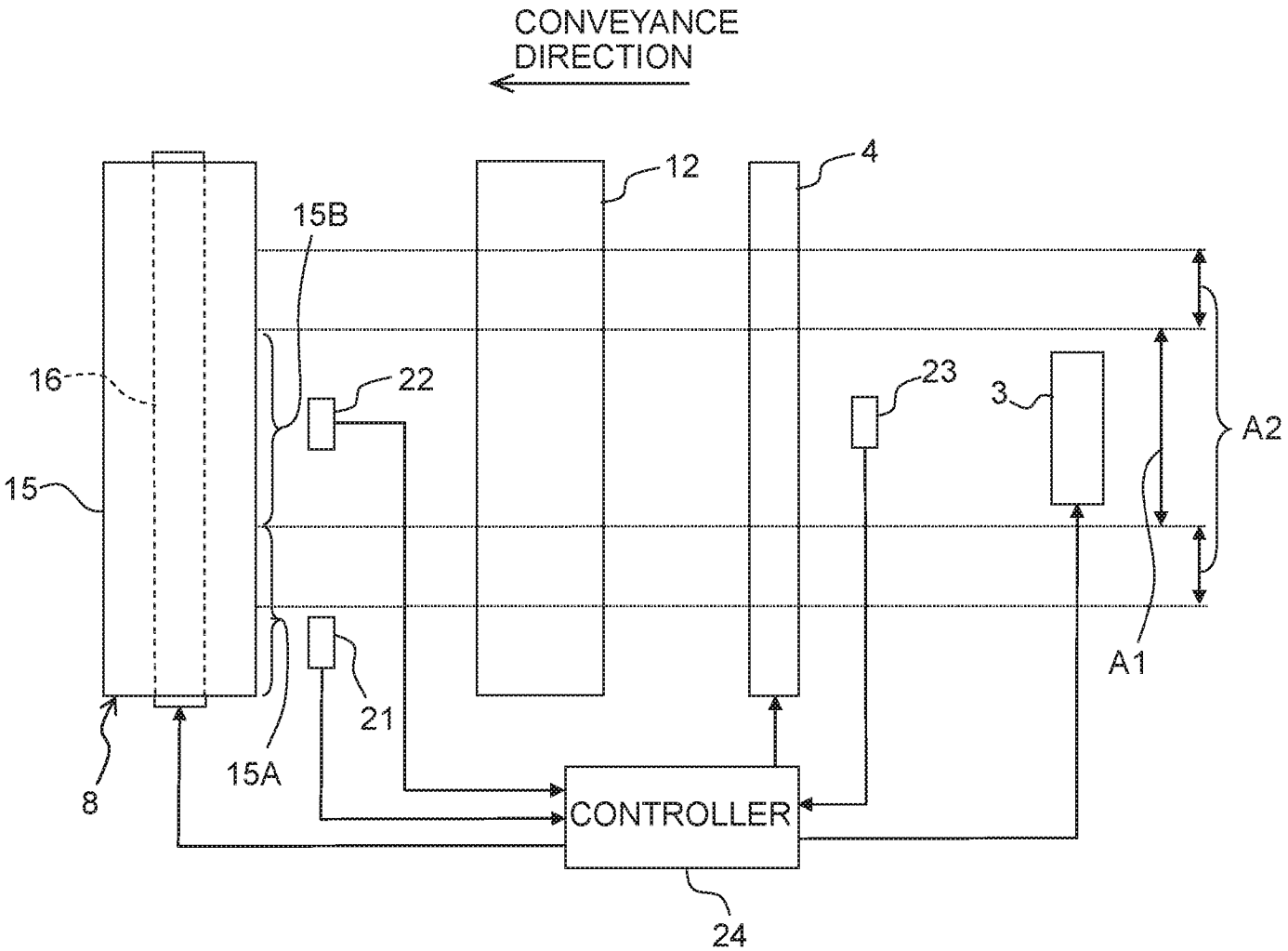
FIG. 2 illustrates a controller of the image forming apparatus depicted in FIG. 1.

In a first embodiment, as depicted in FIG. 2, the image forming apparatus 1 includes a controller 24 and a side temperature sensor 21 as an exemplary temperature sensor. The side temperature sensor 21 measures a temperature of an end region 15A of the heating roller 15 in the width direction.

Figure 3:
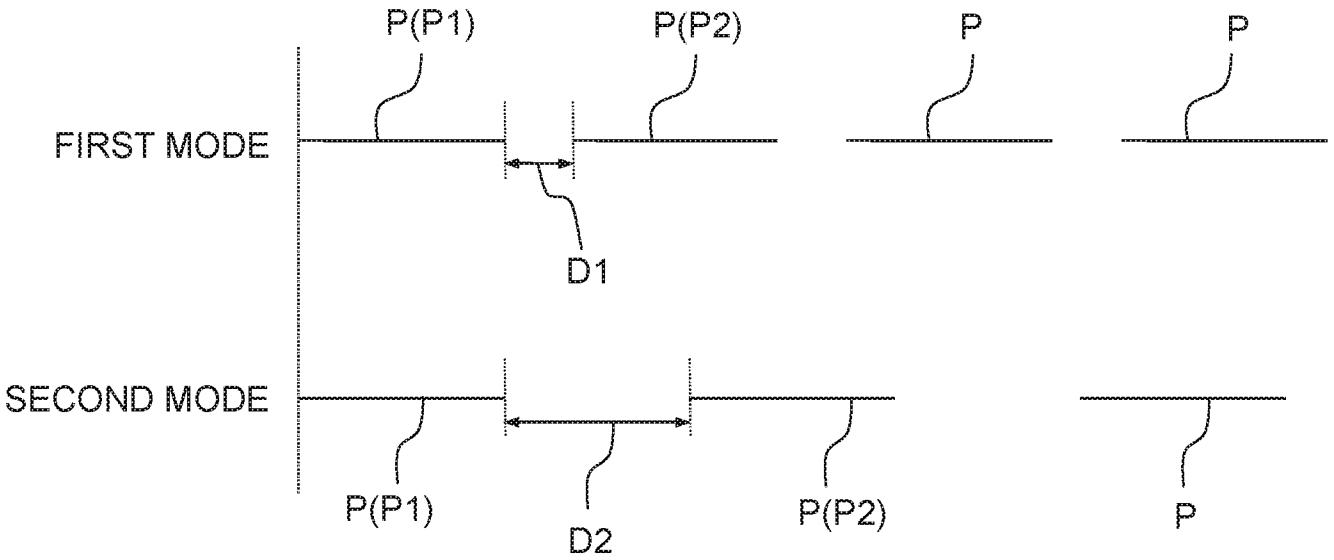
FIG. 3 illustrates a first mode and a second mode.

As depicted in FIG. 3, the controller 24 selectively executes a first mode and a second mode when the image forming apparatus 1 executes continuous printing in which images are formed continuously on sheets P. In other words, the controller 24 selectively executes the first mode and the second mode when the image forming apparatus 1 executes the continuous printing in which an image is formed on a sheet P2 continuously after an image is formed on a sheet P1. In the first mode, the pickup roller 3 conveys the sheet P1 first, then conveys the sheet P2 at an interval D1. In the second mode, the pickup roller 3 conveys the sheet P1 first, then conveys the sheet P2 at an interval D2 that is longer than the interval D1. Namely, the number of sheets to be processed per unit time (hereinafter also referred to as "page per minute") in the second mode is smaller than the page per minute in the first mode.

The controller 24 determines whether to execute the continuous printing. For example, when one job including data to be printed on sheets P is printed, the controller 24 may determine to process the job as one continuous printing. Further, when multiple jobs are printed collectively, the controller 24 may determine to process the jobs as one continuous printing.

Each of the interval D1 and the interval D2 is an interval between the preceding sheet P1 and the sheet P2 conveyed next to the sheet P1 in the printing operation which has been determined by the controller 24 to be processed as one continuous printing. The controller 24 may control the interval D1 and the interval D2 as time intervals. Specifically, the controller 24 may control the pickup roller 3 so that the sheet P1 is fed first and the sheet P2 is fed after the elapse of a predefined time. The controller 24 may control the interval D1 and the interval D2 as distance intervals. Specifically, the controller 24 may control the pickup roller 3 so that the sheet P1 is fed first and the sheet P2 is fed after the sheet P1 has passed through a predefined position. More specifically, the controller 24 may control the pickup roller 3 so that the sheet P1 is fed first and the sheet P2 is fed after a predefined time has passed after detection of a rear end of the sheet P1 by a length sensor 23.

When the controller 24 interrupts printing during the continuous printing of the image forming apparatus 1, the controller 24 determines whether the continuous printing is again executed when the printing is restarted. The case in which the controller 24 interrupts the printing includes, for example, clearing paper jam by a user, supplying sheets by a user, and exchanging consumable supplies, such as developing cartridges, by a user. The interval caused by the interruption of the printing corresponds neither to the interval D1 nor to the interval D2.

Figure 4A:
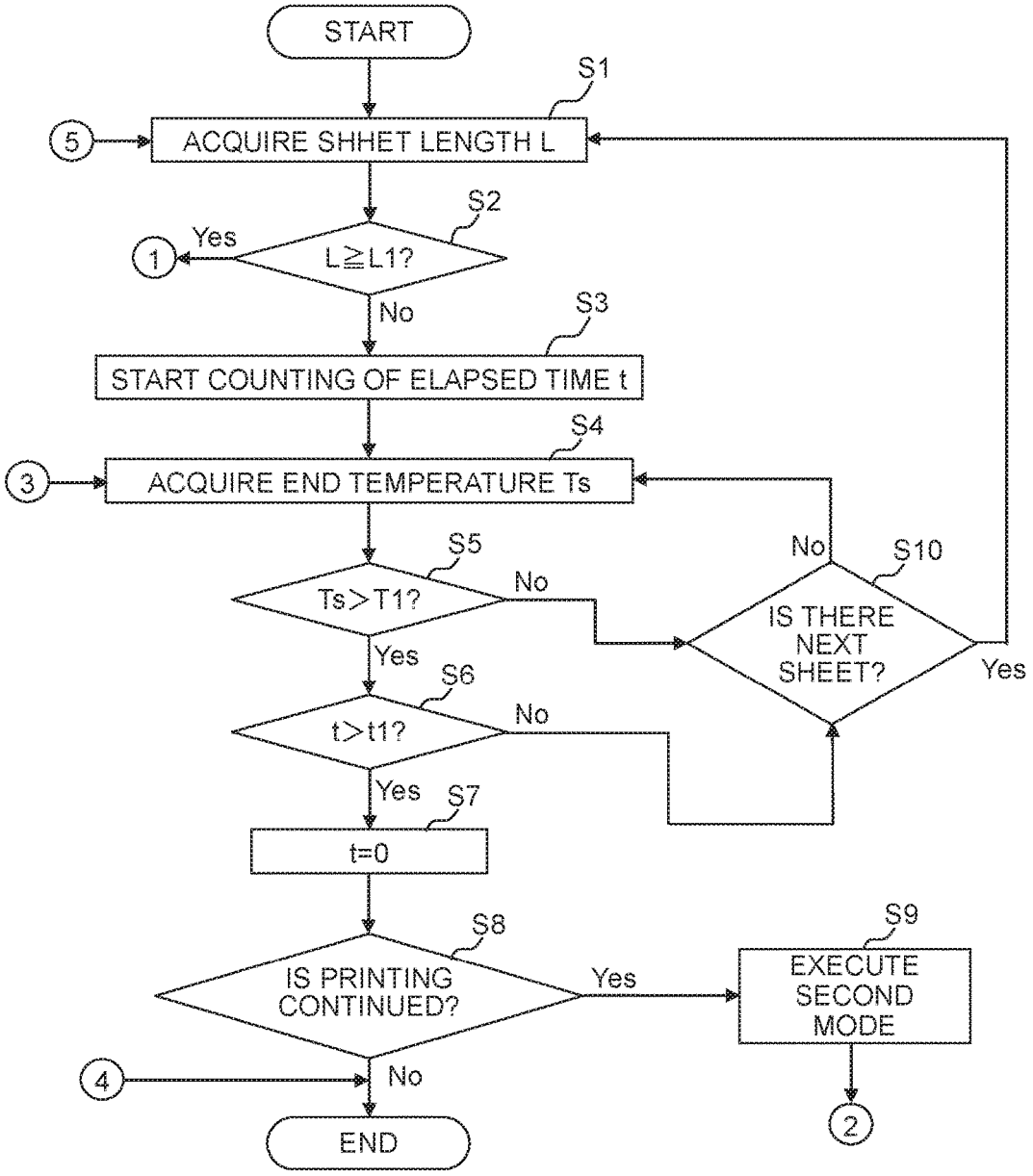
FIGS. 4A to 4C are flowcharts indicating control of the image forming apparatus according to a first embodiment.

In the first embodiment, as depicted in FIG. 4A, the controller 24 executes the second mode (see FIG. 3) when the controller 24 has determined that a time t1 has passed after the image forming apparatus 1 starts the continuous printing in the first mode (see FIG. 3) and that a temperature Ts of the end region 15A of the heating roller 15 (hereinafter also referred to as an end temperature Ts) is higher than a temperature T1 (S5: YES, S6: YES) (S10).

Hereinafter, the first embodiment is explained in detail.

<Side Temperature Sensor, Center Temperature Sensor, and Length Sensor>

As depicted in FIG. 2, the image forming apparatus 1 includes the side temperature sensor 21, a center temperature sensor 22, and the length sensor 23.

The side temperature sensor 21 outputs a signal corresponding to a temperature of the end region 15A of the heating roller 15 in the width direction. Here, the end region 15A of the heating roller 15 is defined as a portion, in the width direction, positioned inside a heating area of the halogen heater 16 and positioned outside an area A1 through which a sheet having a small size described later passes. The side temperature sensor 21 may be a contact-type temperature sensor in contact with a surface of the heating roller 15 or a non-contact type temperature sensor disposed at a position separated from the surface of the heating roller 15 at a predefined interval. The side temperature sensor 21 is preferably the contact-type temperature sensor. In that case, the side temperature sensor 21 is positioned, in the width direction, outside the area A1 and an area A2 through which no small sheet passes and a sheet having a large size described later passes so that the side temperature sensor 21 has contact with no sheet. The side temperature sensor 21 is electrically connected to the controller 24. This allows the signal output from the side temperature sensor 21 to be transmitted to the controller 24.

The center temperature sensor 22 measures a temperature of a center region of the heating roller 15 in the width direction. The center temperature sensor 22 outputs a signal corresponding to a temperature of a center region 15B of the heating roller 15 in the width direction. The center region 15B of the heating roller 15 is defined as a portion positioned inside the area A1 in the width direction. The center temperature sensor 22 may be a contact-type temperature sensor that makes contact with the surface of the heating roller 15 or a non-contact type temperature sensor disposed at a position separated from the surface of the heating roller 15 at a predefined interval. The center temperature sensor 22 is preferably the non-contact type temperature sensor. In that case, the center temperature sensor 22 is prevented from making contact with the sheet. The center temperature sensor 22 is electrically connected to the controller 24. This transmits a signal output from the center temperature sensor 22 to the controller 24.

The length sensor 23 measures a length of the sheet in the sheet conveyance direction. In the following, the length of the sheet in the conveyance direction is described as a sheet length L. Specifically, the length sensor 23 makes contact with the sheet when the sheet passes the area A2. The length sensor 23 outputs an ON signal in a state of making contact with the sheet. The length sensor 23 stops output of the ON signal when having no contact with the sheet. Namely, when the sheet passes the area A2, the length sensor 23 outputs the ON signal for a time corresponding to the sheet length L. The length sensor 23 is electrically connected to the controller 24. This transmits the ON signal output from the length sensor 23 to the controller 24. The controller 24 determines the sheet length L based on the time during which the ON signal is output.

The image forming apparatus 1 does not include a sensor for measuring a width of the sheet in the width direction. Namely, the controller 24 can not determine the width of the sheet in the width direction. Thus, the controller 24 can not determine whether the sheet passes the area A2.

<Controller>

The controller 24 includes, for example, a control circuit board having an Application Specific Integrated Circuit (ASIC). The controller 24 controls an operation of the image forming apparatus 1 in accordance with a program stored in a memory. Specifically, the controller 24 controls an operation of the pickup roller 3. More specifically, in the first mode, the controller 24 drives the pickup roller 3 at time intervals each corresponding to the interval D1 (see FIG. 3). In the second mode, the controller 24 drives the pickup roller 3 at time intervals each corresponding to the interval D2 (see FIG. 3). The controller 24 controls an operation of the registration roller 4. Specifically, during the continuous printing of the image forming apparatus 1, the controller 24 drives the pickup roller 3, and then drives the registration roller 4 after the elapse of a predefined time. When the length sensor 23 does not output the ON signal after the pickup roller 3 is driven and before the registration roller 4 is driven, the controller interrupts the printing.

<Details of Fixing Unit>

The fixing unit 8 includes one halogen heater 16.

The halogen heater 16 has a temperature distribution in the width direction during generating heat. Specifically, during generating heat, the halogen heater 16 has a peak of temperature at an end, in the width direction, of an area that is capable of generating heat.

The controller 24 controls heat generation of the halogen heater 16 based on the signal from the center temperature sensor 22. Specifically, the controller 24 increases the output of the halogen heater 16 per unit time as the temperature of the center region 15B of the heating roller 15 is lower than a predefined target temperature, based on the signal from the center temperature sensor 22. Further, the controller 24 decreases the output of the halogen heater 16 per unit time as the temperature of the center region 15B of the heating roller 15 is higher than the predefined target temperature, based on the signal from the center temperature sensor 22.

The target temperature is set to a temperature higher than a melting point of the toner by equal to or more than 60° C. so that the toner is reliably fixed to the sheet. Specifically, the target temperature is 170° C.

When the image forming apparatus 1 executes the continuous printing, a time during which the sheet is in contact with the heating roller 15 is longer as the interval between the sheet P1 (see FIG. 3) and the sheet P2 (see FIG. 3) is smaller. In that case, the sheet deprives the heating roller 15 of heat to decrease the temperature of the heating roller 15. Thus, during the continuous printing of the image forming apparatus 1, the controller 24 increases the output of the halogen heater 16 per unit time as the interval between the sheet P1 and the sheet P2 is smaller.

During the continuous printing of the image forming apparatus 1, the time during which the sheet is in contact with the heating roller 15 is shorter as the interval between the sheet P1 and the sheet P2 is larger. In that case, the sheet does not deprive the heating roller 15 of heat, which prevents the temperature of the heating roller 15 from decreasing. Thus, during the continuous printing of the image forming apparatus 1, the controller 24 decreases the output of the halogen heater 16 per unit time as the interval between the sheet P1 and the sheet P2 is larger.

<Operation Control of Image Forming Apparatus>

Hereinafter, operation control of the image forming apparatus 1 by the controller 24 is explained.

In the continuous printing, the controller 24 executes the first mode (see FIG. 3). This makes the image forming apparatus 1 start the continuous printing in the first mode.

Subsequently, the controller 24 determines the size of the sheet, as indicated in FIG. 4A (S1, S2).

Specifically, the controller 24 acquires the sheet length L based on the ON signal from the length sensor 23 (see FIG. 2) (S1).

Subsequently, the controller 24 determines whether the sheet length L is longer than a predefined length L1 (S2). When the controller 24 has determined that the sheet length L is less than the predefined length L1 (S2: NO), the controller 24 controls the operation of the image forming apparatus 1 in accordance with flowcharts indicated in FIGS. 4A and 4B. In the following, a sheet having a sheet length L of less than the predefined length L1 is described as a sheet having a small size or a small sheet. The small sheet passes the area A1 (see FIG. 2) and does not pass the area A2 (see FIG. 2). When the controller 24 has determined that the sheet length L is longer than the predefined length L1 (S2: YES), the controller 24 controls the operation of the image forming apparatus 1 in accordance with a flowchart indicated in FIG. 4C. In the following, a sheet having a sheet length L of longer than the predefined length L1 is described as a sheet having a large size or a large sheet. The large sheet passes the areas A1 and A2.

As described above, the controller 24 includes no sensor for determining the width of the sheet. This can reduce manufacturing costs of the image forming apparatus 1.

<Printing Performed on Small Sheet>

As indicated in FIG. 4A, when the controller 24 has determined that the sheet length L is less than the predefined length L1 (S2: NO), when the controller 24 has determined that the time t1 has passed (S6: YES) after the image forming apparatus 1 starts the continuous printing in the first mode, and when the controller 24 has determined based on the signal from the side temperature sensor 21 that the temperature of the end region 15A of the heating roller 15 is higher than the temperature T1 (S5: YES), the controller 24 executes the second mode (S9).

Specifically, when the controller 24 has determined that the sheet length L is less than the predefined length L1 (S2: NO), the controller 24 starts a count of elapsed time t (S3) and acquires the end temperature Ts (S4).

Subsequently, the controller 24 determines whether the end temperature Ts is higher than the temperature T1 (S5).

The temperature T1 is set to prevent the end region 15A of the heating roller 15 from being excessively heated. Specifically, the temperature T1 is 190° C.

When the controller 24 has determined that the end temperature Ts is higher than the temperature T1 (S5: YES), the controller 24 determines whether the elapsed time t has exceeded the time t1 (S6).

The time t1 is set so that the image forming apparatus 1 can process the number of sheets to be processed per unit time without having any trouble. Specifically, the time t1 is 60 seconds. The time t1 corresponds to a time during which printing for 30 surfaces is completed.

When the controller 24 has determined that the elapsed time t has exceeded the time t1 (S6: YES), the controller 24 resets the elapsed time t (S7). When the printing is continued (S8: YES), the controller 24 executes the second mode (S9).

Here, the above control is explained by using a concrete sheet size as an example. In the following, the predefined length L1 is the length of a long side of an A4 sheet. The width of the area A1 (see FIG. 2) is the same as the length of a short side of a A5 sheet. The width acquired by combining the area A1 and the area A2 (see FIG. 2) is the same as the length of a short side of the A4 sheet.

When the A5 sheet is stored in the feed tray 2 (see FIG. 1) and the short side of the A5 sheet extends in the width direction, the A5 sheet passes the area A1 and does not pass the area A2.

In that case, although the temperature of the center region 15B of the heating roller 15 falls due to the contact with the A5 sheet, the temperature of the end region 15A of the heating roller 15 is not likely to fall due to no contact with the A5 sheet.

Although the temperature of the end region 15A of the heating roller 15 is not likely to fall, the controller 24 increases the output of the halogen heater 16 based on the signal from the center temperature sensor 22 (see FIG. 2) so that the temperature of the center region 15B of the heating roller 15 is closer to the target temperature. This makes the temperature of the end region 15A of the heating roller 15 higher than the temperature T1 in a short time.

When the controller 24 has determined that the end temperature Ts is higher than the temperature T1 (S5: YES) and that the elapsed time t has exceeded the time t1 (S6: YES), the controller 24 resets the elapsed time t (S7). When the printing is continued (S8: YES), the controller 24 executes the second mode (S9).

When the A5 sheet is stored in the feed tray 2 (see FIG. 1) and the long side of the A5 sheet extends in the width direction, the sheet passes the area A1 and the area A2.

In that case, the end temperature Ts falls by the contact with the A5 sheet, like the temperature of the center region 15B of the heating roller 15.

Thus, even when the controller 24 increases the output of the halogen heater 16, the end temperature Ts is not likely to rise.

As a result, when the long side of the A5 sheet extends in the width direction, a time elapsed before the end temperature Ts is higher than the temperature T1 is longer than a case in which the short side of the A5 sheet extends in the width direction. Namely, when the long side of the A5 sheet extends in the width direction, the controller 24 executes the first mode for a longer time than the case in which the short side of the A5 sheet extends in the width direction.

In the above control, when the printing is not continued (S8: NO), the controller 24 ends the continuous printing.

When the controller 24 has determined that the end temperature Ts is lower than the temperature T1 (S5: NO) or that the elapsed time t is shorter than the time t1 (S6: NO), the controller 24 determines the absence or presence of the next sheet based on the ON signal from the length sensor 23 (S10).

When the controller 24 has determined that the ON signal is output from the length sensor 23 and that the next sheet is present (S10: YES), the controller 24 acquires a sheet length L of the next sheet (S1). Thus, when the next sheet is the large sheet (S1: YES), the controller 24 can shift to the control for printing on the large sheet (see FIG. 4C) in a state of executing the first mode.

When the length sensor 23 does not detect the next sheet (S10: NO), the controller 24 acquires the end temperature Ts (S4).

Figure 4B:
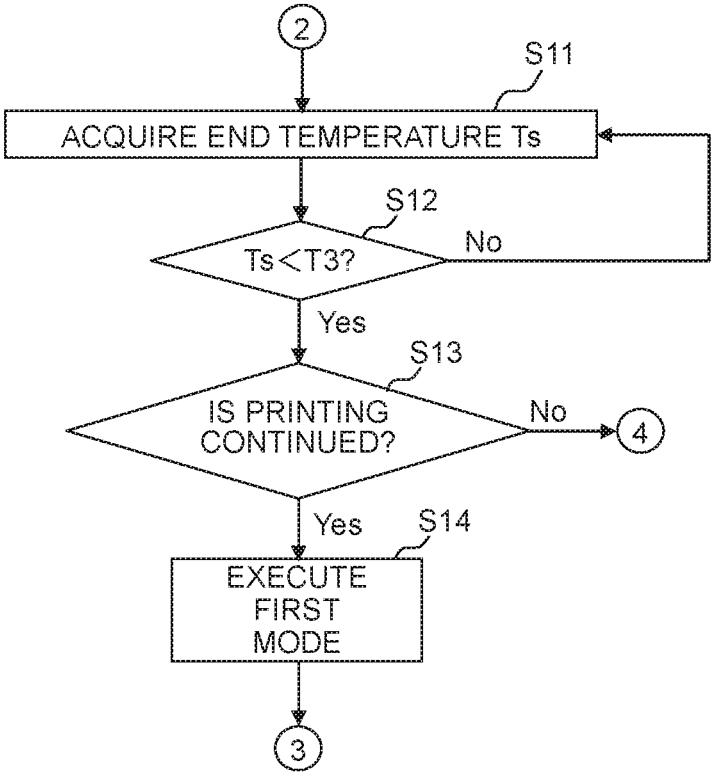

As depicted in FIG. 4B, after executing the second mode (S9), when the controller 24 has determined based on the signal from the side temperature sensor 21 that the end temperature Ts is lower than a temperature T3 (S12: YES), and when the printing is continued (S13: YES), the controller 24 executes the first mode (S14). This allows the controller 24 to return to the first mode after executing the second mode.

The temperature T3 is lower than the temperature T1. Specifically, the temperature T3 is lower than the temperature T1 by equal to or more than 10° C. Specifically, the temperature T3 is 160° C. Making the temperature T3 lower than the temperature T1 prevents the controller 24 from quickly returning to the first mode after executing the second mode.

When the controller 24 has determined that the end temperature Ts is higher than the temperature T3 (S12: NO), the controller 24 acquires the end temperature Ts (S11). When the printing is not continued (S13: NO), the controller 24 ends the continuous printing. After executing the first mode (S14), the controller 24 acquires the end temperature Ts (S4, see FIG. 4A).

<Printing Performed on Large Sheet>

Figure 4C:
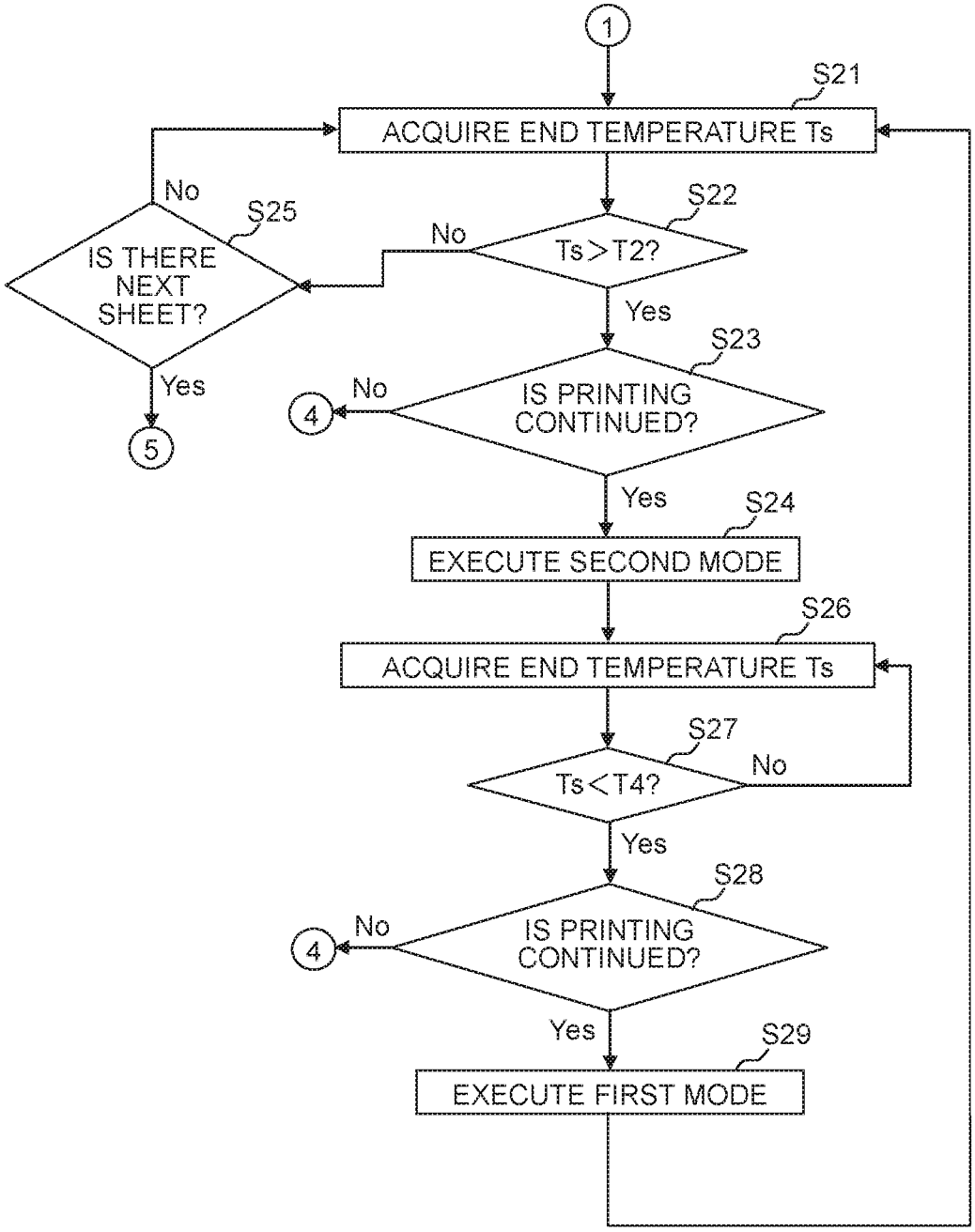

As depicted in FIG. 4C, when the controller 24 has determined that the sheet length L is equal to or more than the predefined length L1 (S2: YES, see FIG. 4A) and when the controller 24 has determined based on the signal from the side temperature sensor 21 that the end temperature Ts is higher than a temperature T2 (S22: YES), the controller 24 executes the second mode (S24).

Specifically, when the controller 24 has determined that the sheet length L is equal to or more than the predefined length L1 (S2: YES, see FIG. 4A), the controller 24 acquires the end temperature Ts (S21).

Subsequently, the controller 24 determines whether the end temperature Ts is higher than the temperature T2 (S22).

Like the temperature T1, the temperature T2 is set to prevent the end region 15A of the heating roller 15 from being excessively heated. The temperature T2 is higher than the temperature T1. Specifically, the temperature T2 is 210° C. When printing is performed on the large sheet, the large sheet passes the area A2 (see FIG. 2). This makes it difficult to raise the end temperature Ts. Thus, when printing is performed on the large sheet, the end temperature Ts for executing the second mode is made to be higher than that of a case in which printing is performed on the small sheet. In other words, when printing is performed on the large sheet, the condition of the end temperature Ts for maintaining the first mode is not stricter than the case in which printing is performed on the small sheet. This allows the controller 24 to execute the first mode for a longer time than the case in which printing is performed on the small sheet.

When the controller 24 has determined that the end temperature Ts has exceeded the temperature T2 (S22: YES), and when the printing is continued (S23: YES), the controller 24 executes the second mode (S24).

When the printing is not continued (S23: NO), the controller 24 ends the continuous printing.

When the controller 24 has determined that the end temperature Ts is lower than the temperature T2 (S22: NO), the controller 24 determines the absence or presence of the next sheet based on the ON signal from the length sensor 23 (S25).

When the controller 24 has determined that the ON signal is output from the length sensor 23 and that the next sheet is present (S25: YES), the controller 24 acquires a sheet length L of the next sheet (S1, see FIG. 4A). Thus, when the next sheet is the small sheet (S1: NO), the controller 24 can shift to the control for printing on the small sheet (see FIGS. 4A and 4B) in a state of executing the first mode.

When the length sensor 23 does not detect the next sheet (S25: NO), the controller 24 acquires the end temperature Ts (S21).

After executing the second mode (S9), when the controller 24 has determined based on the signal from the side temperature sensor 21 that the end temperature Ts is lower than a temperature T4 (S27: YES), and when the printing is continued (S28: YES), the controller 24 executes the first mode (S29). This allows the controller 24 to return to the first mode.

The temperature T4 is lower than the temperature T2. Specifically, the temperature T4 is lower than the temperature T2 by equal to or more than 10° C. More specifically, the temperature T4 is 160° C. Making the temperature T4 lower than the temperature T2 prevents the controller 24 from quickly returning to the first mode after executing the second mode.

When the controller 24 has determined that the end temperature Ts is higher than the temperature T4 (S27: NO), the controller 24 acquires the end temperature Ts (S26). When the printing is not continued (S28: NO), the controller 24 ends the continuous printing. Further, after executing the first mode (S29), the controller 24 acquires the end temperature Ts (S21).

<Action and Effect>

In the image forming apparatus 1, as depicted in FIG. 4A, the controller 24 can continue executing the first mode even when the time t1 has elapsed (FIG. 4C: YES) after the image forming apparatus 1 starts the continuous printing in the first mode (see FIG. 3), provided that the controller 24 determines based on the signal from the side temperature sensor 21 (see FIG. 2) that the temperature of the end region 15A of the heating roller 15 (end temperature Ts) is lower than the temperature T1 (S5: NO).

Thus, regardless of the end temperature Ts, when the time t1 has elapsed, the controller 24 can execute the first mode for a longer time than a case in which the second mode is executed.

This prevents the number of sheets to be processed per unit time from being reduced when the end temperature Ts is not required to be decreased, making it possible to increase the number of sheets to be processed per unit time.

When the time t1 has elapsed (S6: YES) after the image forming apparatus 1 starts the continuous printing in the first mode, and when the end temperature Ts is higher than the temperature T1 (S5: YES), the controller 24 executes the second mode (S9) to decrease the end temperature Ts.

This prevents the end region 15A of the heating roller 15 from being excessively heated, thus protecting the heating roller 15.

<Second Embodiment>

Figure 5:
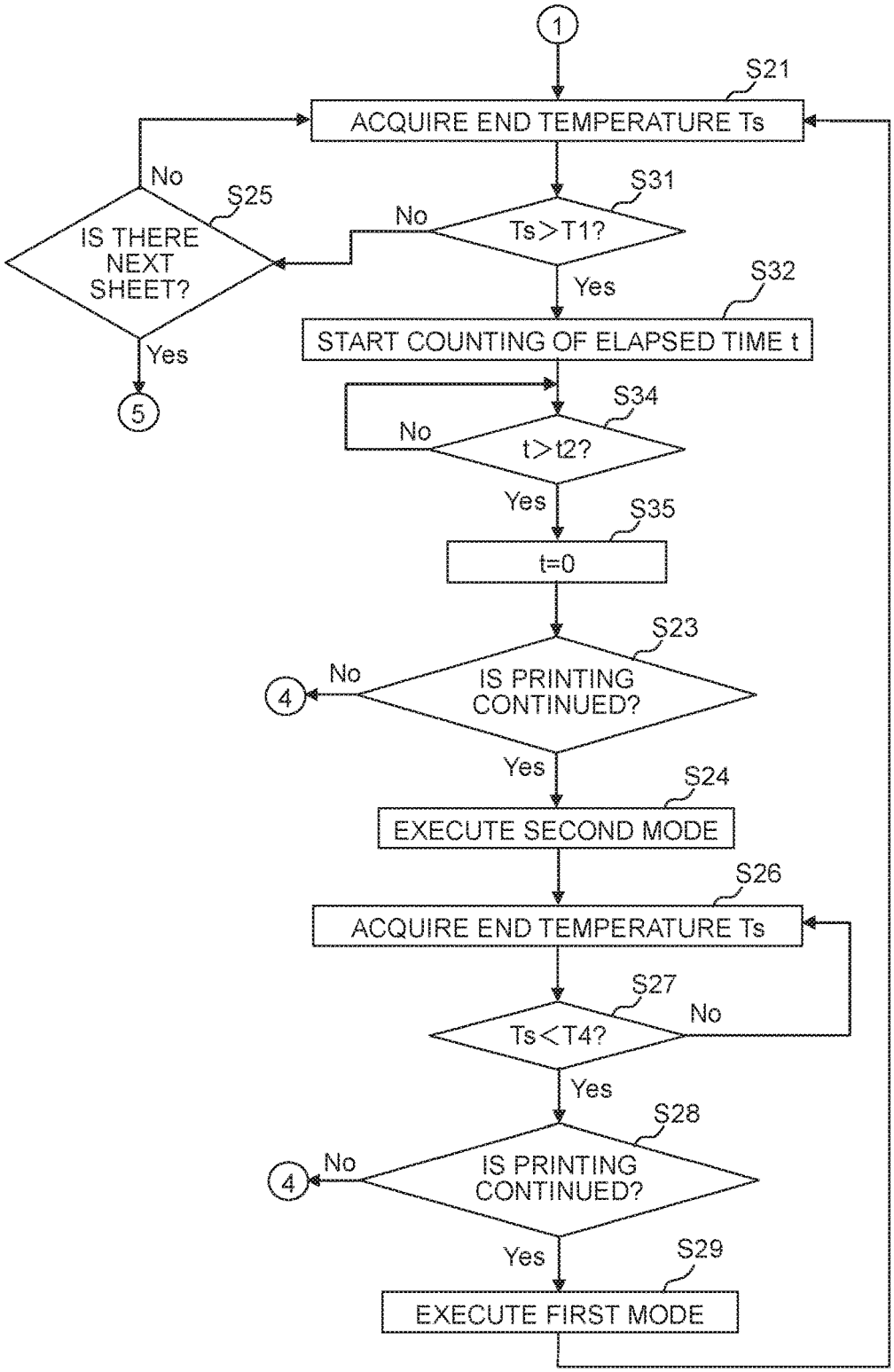
FIG. 5 is a flowchart indicating control of the image forming apparatus according to a second embodiment, wherein printing is performed on a sheet having a large size.

In the following, as depicted in FIG. 5, a second embodiment is explained. In the second embodiment, the constitutive parts or components and the processing, which are the same as or equivalent to those of the first embodiment, are designated by the same reference numerals, and any explanation therefor will be omitted as appropriate.

In the second embodiment, as for determination of the sheet size and printing on the small sheet, the controller 24 executes the same control as that of the first embodiment (see FIGS. 4A and 4B).

In the second embodiment, as depicted in FIG. 5, the controller 24 determines whether the end temperature Ts is higher than the temperature T1 (S31) when printing is performed on the large sheet, instead of the processing (S22, see FIG. 4C) of determining whether the end temperature Ts is higher than the temperature T2 that is performed in the first embodiment. When the controller 24 has determined that the end temperature Ts is higher than the temperature T1 (S31: YES), the controller 24 determines whether a t2 has elapsed (S33).

Namely, when the controller 24 has determined that the sheet length L is equal to or more than the predefined length L1 (S2: YES, see FIG. 4A), and when the controller 24 has determined that the time t2 has elapsed (S33: YES) after determining, based on the signal from the side temperature sensor 21, that the end temperature Ts has reached the temperature T1 (S31: YES), the controller 24 executes the second mode (S24).

Specifically, when the controller 24 has determined that the sheet length L is equal to or more than the predefined length L1 (S2: YES, see FIG. 4A), the controller 24 acquires the end temperature Ts (S21).

Subsequently, the controller 24 determines whether the end temperature Ts is higher than the temperature T1 (S31). Namely, the controller 24 adopts the temperature T1, which is used for the case in which printing is performed on the small sheet, as a reference for determining whether the end temperature Ts has risen excessively.

As described in the first embodiment, when printing is performed in the large sheet, the large sheet passes the area A2 (see FIG. 2). This makes it difficult to raise the end temperature Ts. Thus, when printing is performed on the large sheet, the condition for maintaining the first mode is preferably not stricter than the case in which printing is performed on the small sheet.

In the second embodiment, the controller 24 determines whether the end temperature Ts is higher than the temperature T1 (S31). When the end temperature Ts is higher than the temperature T1 (S31: YES), the controller 24 starts a count of elapsed time t (S32) to determine whether the elapsed time t has exceeded the time t2 (S33). Then, when the elapsed time t has exceeded the time t2 (S33: YES), the controller 24 resets the elapsed time t (S34). When the printing is continued (S23: YES), the controller 24 executes the second mode (S24).

The time t2 is a time required to raise the end temperature Ts from the temperature T1 to the temperature T2 when printing is performed on the large sheet. Namely, when printing is performed on the large sheet, it is assumed that the end temperature Ts reaches the temperature T1 first, then reaches the temperature T2 after the time t2 has elapsed.

Thus, the controller 24 executes the first mode for a longer time than the case in which printing is performed on the small sheet, as in the first embodiment.

The second embodiment can obtain the same action and effect as those of the first embodiment.

<Third Embodiment>

Figure 6A:
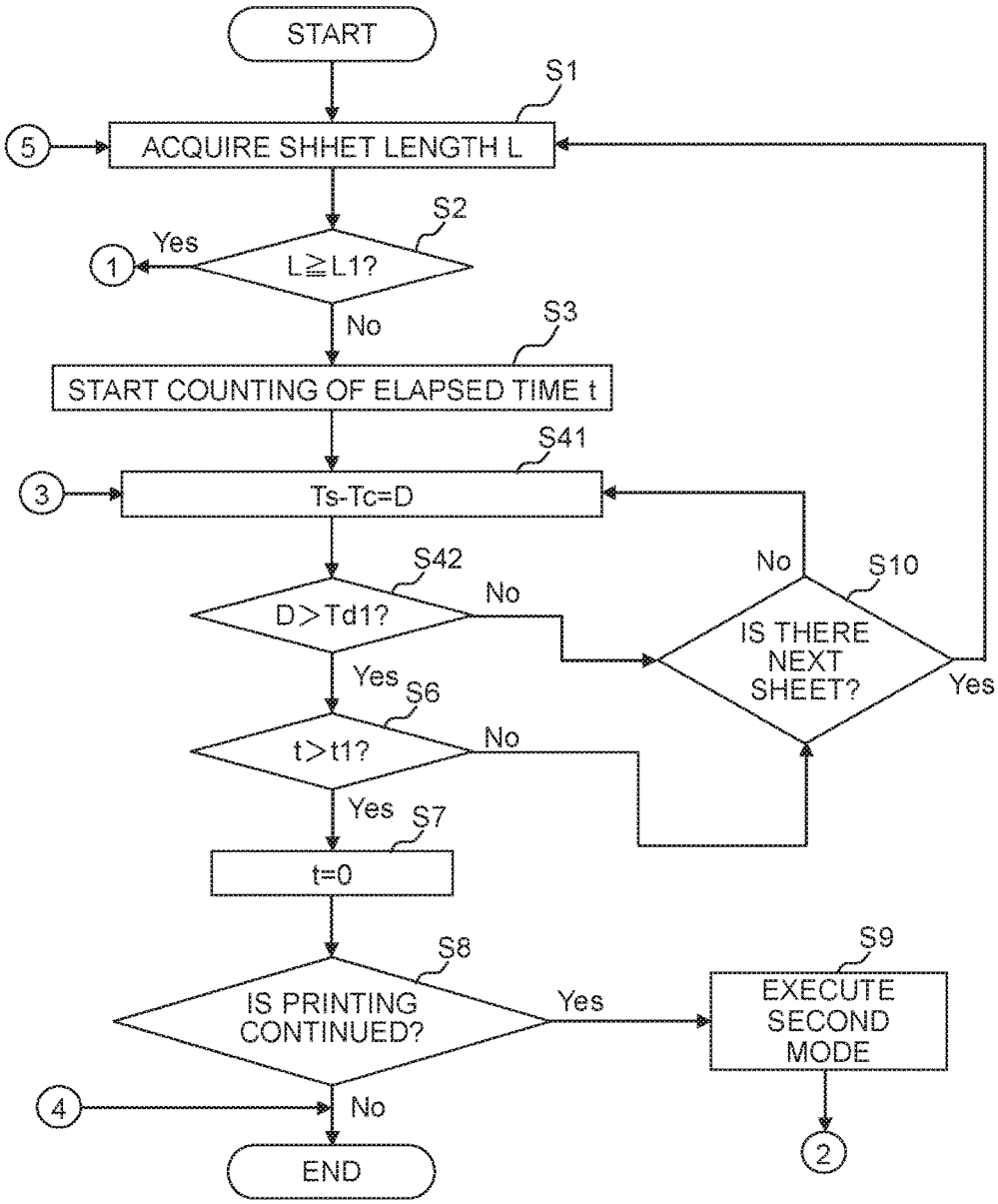
FIGS. 6A to 6C are flowcharts indicating control of the image forming apparatus according to a third embodiment.
Figure 6B:
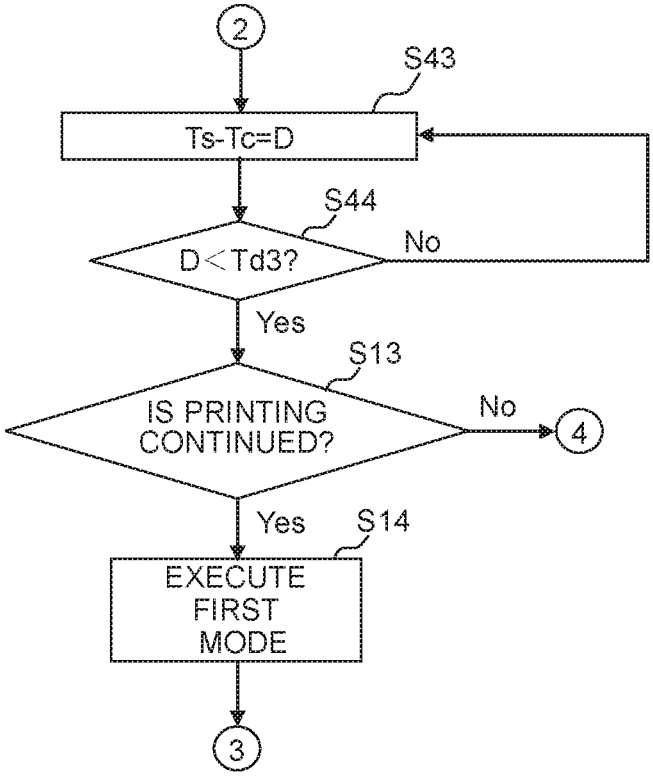
Figure 6C:
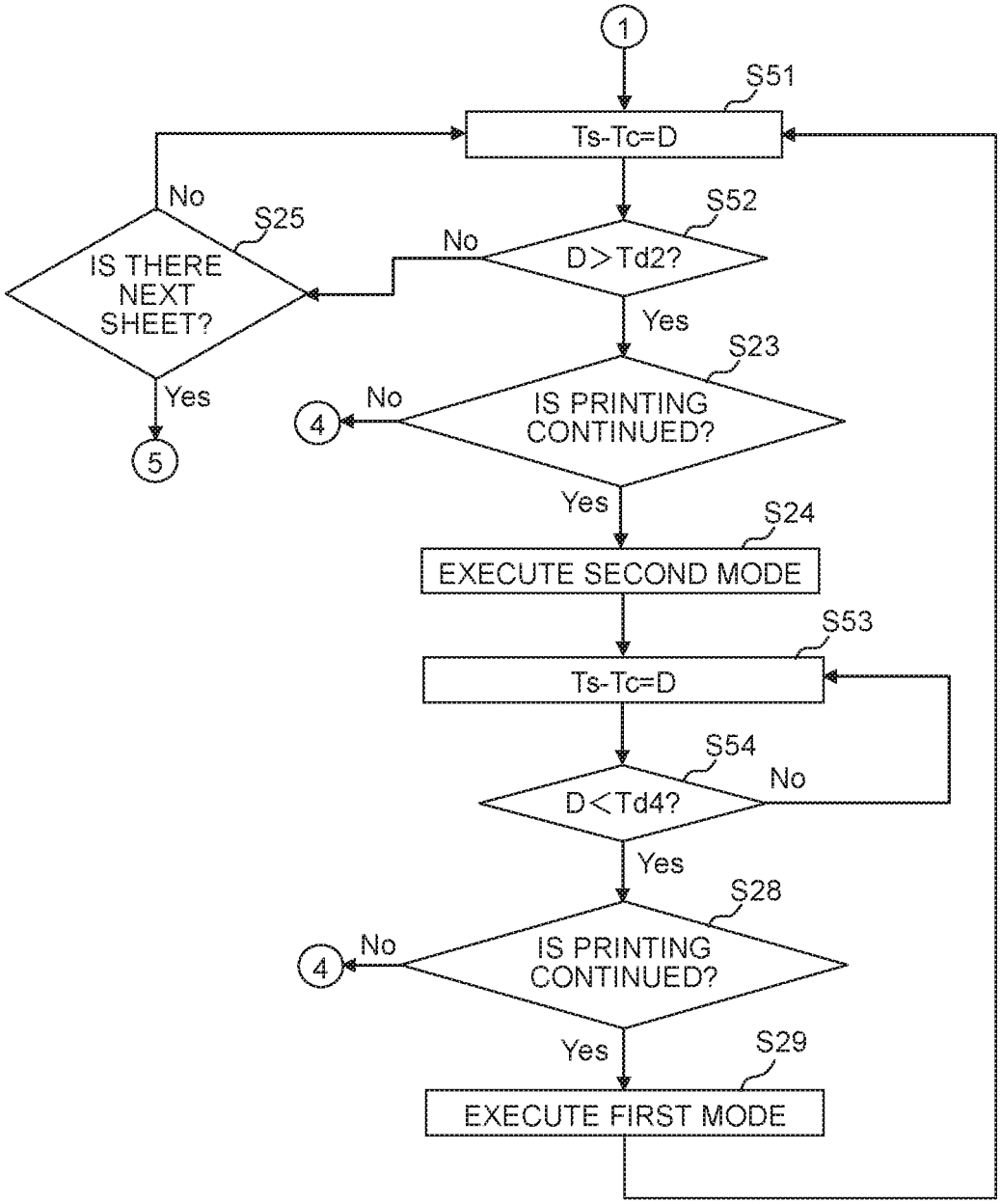

In the following, as depicted in FIGS. 6A to 6C, a third embodiment is explained. In the third embodiment, the constitutive parts or components and the processing, which are the same as or equivalent to those of the first embodiment, are designated by the same reference numerals, and any explanation therefor will be omitted as appropriate.

The third embodiment adopts a difference D between the end temperature Ts and the temperature of the center region 15B (see FIG. 2) of the heating roller 15, instead of the end temperature Ts in the first embodiment. In the following, the temperature of the center region 15B of the heating roller 15 is described as a center temperature Tc. The end temperature Ts is measured based on the signal from the side temperature sensor 21 (see FIG. 2) that is an exemplary first temperature sensor, as in the first embodiment. The center temperature Tc is measured based on the signal from the center temperature sense 22 (see FIG. 2) that is an exemplary second temperature sensor.

Specifically, as depicted in FIG. 6A, when the controller 24 has determined that the sheet length L is less than the predefined length L1 (S2: NO), at first, the image forming apparatus 1 starts the continuous printing in the first mode. Then, when the controller 24 has determined that the time t1 has elapsed (S6: YES) and when the controller 24 has determined based on the signal from the side temperature sensor 21 and the signal from the sensor temperature sensor 22 that the difference D between the end temperature Ts and the center temperature Tc (S41) is larger than a threshold value Td1 (S42: YES), the controller 242 executes the second mode (S9).

As depicted in FIG. 6B, when the controller 24 has determined based on the signal from the side temperature sensor 21 and the signal from the center temperature sensor 22 that the difference D between the end temperature Ts and the center temperature Tc (S43) is smaller than a threshold value Td3 (S44: YES), the controller 24 executes the first mode (S14).

The threshold value Td3 is smaller than the threshold value Td1. Specifically, the threshold value Td3 is smaller than the threshold value Td1 by equal to or more than 30° C. Making the threshold value Td3 smaller than the threshold value Td1 prevents the controller 24 from quickly returning to the first mode after executing the second mode.

As depicted in FIG. 6C, when the controller 24 has determined that the sheet length L is equal to or more than the predefined length L1 (S2: YES, see FIG. 6A), and when the controller 24 has determined based on the signal from the side temperature sensor 21 and the signal from the center temperature sensor 22 that the difference D between the end temperature Ts and the center temperature Tc (S51) is larger than a threshold value Td2 (S52), the controller 24 executes the second mode (S24).

The threshold value Td2 is larger than the threshold value Td1. Making the threshold value Td2 larger than the threshold value Td1 allows the controller 24 to execute the first mode for a longer time than the case in which printing is performed on the small sheet, as in the first embodiment.

After executing the second mode, when the controller 24 has determined based on the signal from the side temperature sensor 21 and the signal from the center temperature sensor 22 that the difference D between the end temperature Ts and the center temperature Tc (S53) is smaller than a threshold value Td4 (S54), the controller 24 executes the first mode.

The threshold value Td4 is smaller than the threshold value Td2. Specifically, the threshold value Td4 is smaller than the threshold value Td2 by equal to or more than 30° C. Making the temperature T4 lower than the temperature T2 prevents the controller 24 from quickly returning to the first mode after executing the second mode.

<Modified Examples>

Similar to the third embodiment, the second embodiment can adopt the difference D between the end temperature Ts and the center temperature Tc, instead of the end temperature Ts. Namely, in the second embodiment, the step S41 in FIG. 6A can be adopted instead of the step S21 in FIG. 5, and the step S42 in FIG. 6A can be adopted instead of the step S31 in FIG. 5. In that case, when the controller 24 has determined that the sheet length L is equal to or more than the predefined length L1 (S2: YES, see FIG. 4A), and when the controller 24 has determined that the time t2 has elapsed (S33, see FIG. 5) after determing, based on the signal from the side temperature sensor 21 and the signal from the center temperature sensor 22, that the difference D (S41, see FIG. 6A) between the end temperature Ts and the center temperature Tc has reached the threshold value Td1 (S42, see FIG. 6A), the controller 24 can execute the second mode (S24, see FIG. 5).

In each of the embodiments, the registration roller 4 may be an exemplary roller.

The length sensor 23 may be disposed downstream of the registration roller 4.

A heating belt may be an exemplary heating member.

What is claimed is:

1. An image forming apparatus, comprising:

a roller configured to convey a sheet;

a heating member configured to heat the sheet conveyed by the roller and extending in a width direction orthogonal to a conveyance direction of the sheet;

a temperature sensor configured to output a signal depending on a temperature of an end region of the heating member in the width direction;

a length sensor configured to measure a length of the sheet in the conveyance direction; and a controller electrically connected to the temperature sensor, the controller configured to selectively execute a first mode and a second mode in a case that the image forming apparatus executes continuous printing in which an image is formed on a second sheet continuously after an image is formed on a first sheet, the first mode being a mode in which the roller conveys the first sheet first, and then conveys the second sheet at a first interval, the second mode being a mode in which the roller conveys the first sheet first, and then conveys the second sheet at a second interval longer than the first interval, wherein, when the controller has determined that a first time has elapsed after the image forming apparatus starts the continuous printing in the first mode, and when the controller has determined based on the signal from the temperature sensor that the temperature of the end region of the heating member is higher than a first temperature in executing the first mode, the controller is configured to change the mode of the roller from the first mode to the second mode in the continuous printing in which the first mode has been executed, wherein, when the controller has determined based on a signal from the length sensor that the length of the sheet in the conveyance direction is less than a predefined length, when the controller has determined that the first time has elapsed after the image forming apparatus starts the continuous printing in the first mode, and when the controller has determined based on the signal from the temperature sensor that the temperature of the end region of the heating member is higher than the first temperature in executing the first mode, the controller is configured to change the mode of the roller from the first mode to the second mode in the continuous printing in which the first mode has been executed, and wherein, when the controller has determined based on the signal from the length sensor that the length of the sheet in the conveyance direction is equal to or more than the predefined length, and when the controller has determined based on the signal from the temperature sensor that the temperature of the end region of the heating member is higher than a second temperature which is higher than the first temperature in executing the first mode, the controller is configured to change the mode of the roller from the first mode to the second mode in the continuous printing in which the first mode has been executed.

2. The image forming apparatus according to claim 1, wherein, when the controller has determined based on the signal from the temperature sensor that the temperature of the end region of the heating member is lower than a third temperature which is lower than the first temperature in executing the second mode, the controller is configured to change the mode of the roller from the second mode to the first mode in the continuous printing in which the second mode has been executed.

3. The image forming apparatus according to claim 1, further comprising:

a tray storing the sheet; and a photosensitive drum including a surface on which a toner image is formed, wherein the roller includes a pickup roller configured to convey the sheet in the tray toward the photosensitive drum.

4. An image forming apparatus, comprising:

a roller configured to convey a sheet;

a heating member configured to heat the sheet conveyed by the roller and extending in a width direction orthogonal to a conveyance direction of the sheet;

a temperature sensor configured to output a signal depending on a temperature of an end region of the heating member in the width direction;

a length sensor configured to measure a length of the sheet in the conveyance direction; and a controller electrically connected to the temperature sensor, the controller configured to selectively execute a first mode and a second mode in a case that the image forming apparatus executes continuous printing in which an image is formed on a second sheet continuously after an image is formed on a first sheet, the first mode being a mode in which the roller conveys the first sheet first, and then conveys the second sheet at a first interval, the second mode being a mode in which the roller conveys the first sheet first, and then conveys the second sheet at a second interval longer than the first interval, wherein, when the controller has determined that a first time has elapsed after the image forming apparatus starts the continuous printing in the first mode, and when the controller has determined based on the signal from the temperature sensor that the temperature of the end region of the heating member is higher than a first temperature in executing the first mode, the controller is configured to change the mode of the roller from the first mode to the second mode in the continuous printing in which the first mode has been executed, wherein, when the controller has determined based on a signal from the length sensor that the length of the sheet in the conveyance direction is less than a predefined length, when the controller has determined that the first time has elapsed after the image forming apparatus starts the continuous printing in the first mode, and when the controller has determined based on the signal from the temperature sensor that the temperature of the end region of the heating member is higher than the first temperature in executing the first mode, the controller is configured to change the mode of the roller from the first mode to the second mode in the continuous printing in which the first mode has been executed, wherein, when the controller has determined based on the signal from the length sensor that the length of the sheet in the conveyance direction is equal to or more than the predefined length, and when the controller has determined that a second time has elapsed after determining, based on the signal from the temperature sensor, that the temperature of the end region of the heating member has reached the first temperature in executing the first mode, the controller is configured to change the mode of the roller from the first mode to the second mode in the continuous printing in which the first mode has been executed.

5. The image forming apparatus according to claim 4, wherein, when the controller has determined based on the signal from the temperature sensor that the temperature of the end region of the heating member is lower than a third temperature which is lower than the first temperature in executing the second mode, the controller is configured to change the mode of the roller from the second mode to the first mode in the continuous printing in which the second mode has been executed.

6. The image forming apparatus according to claim 4, further comprising:

a tray storing the sheet; and a photosensitive drum including a surface on which a toner image is formed, wherein the roller includes a pickup roller configured to convey the sheet in the tray toward the photosensitive drum.

7. An image forming apparatus, comprising:

a roller configured to convey a sheet;

a heating member configured to heat the sheet conveyed by the roller and extending in a width direction orthogonal to a conveyance direction of the sheet;

a first temperature sensor configured to output a signal depending on a temperature of an end region of the heating member in the width direction;

a second temperature sensor configured to output a signal depending on a temperature of a center region of the heating member in the width direction;

a length sensor configured to measure a length of the sheet in the conveyance direction; and a controller electrically connected to the first temperature sensor and the second temperature sensor, the controller configured to selectively execute a first mode and a second mode in a case that the image forming apparatus executes continuous printing in which an image is formed on a second sheet continuously after an image is formed on a first sheet, the first mode being a mode in which the roller conveys the first sheet first, and then conveys the second sheet at a first interval, the second mode being a mode in which the roller conveys the first sheet first, and then conveys the second sheet at a second interval which is longer than the first interval, wherein, when the controller has determined that a first time has elapsed after the image forming apparatus starts the continuous printing in the first mode, and when the controller has determined based on the signal from the first temperature sensor and the signal from the second temperature sensor that a difference between the temperature of the end region of the heating member and the temperature of the center region of the heating member is greater than a first threshold value, the controller is configured to change the mode of the roller from the first mode to the second mode in the continuous printing in which the first mode has been executed, wherein, when the controller has determined based on a signal from the length sensor that the length of the sheet in the conveyance direction is less than a predefined length, when the controller has determined that the first time has elapsed after the image forming apparatus starts the continuous printing in the first mode, and when the controller has determined based on the signal from the first temperature sensor and the signal from the second temperature sensor that the difference between the temperature of the end region of the heating member and the temperature of the center region of the heating member is greater than the first threshold value, the controller is configured to change the mode of the roller from the first mode to the second mode in the continuous printing in which the first mode has been executed, and wherein, when the controller has determined based on the signal from the length sensor that the length of the sheet in the conveyance direction is equal to or more than the predefined length, and when the controller has determined based on the signal from the first temperature sensor and the signal from the second temperature sensor that the difference between the temperature of the end region of the heating member and the temperature of the center region of the heating member is greater than a second threshold value which is greater than the first threshold value, the controller is configured to change the mode of the roller from the first mode to the second mode in the continuous printing in which the first mode has been executed.

8. The image forming apparatus according to claim 7, wherein, when the controller has determined based on the signal from the first temperature sensor and the signal from the second temperature sensor that the difference between the temperature of the end region of the heating member and the temperature of the center region of the heating member is smaller than a third threshold value which is smaller than the first threshold value in executing the second mode, the controller is configured to change the mode of the roller from the second mode to the first mode in the continuous printing in which the second mode has been executed.

9. The image forming apparatus according to claim 7, further comprising:

a tray storing the sheet; and a photosensitive drum including a surface on which a toner image is formed, wherein the roller includes a pickup roller configured to convey the sheet in the tray toward the photosensitive drum.

10. An image forming apparatus, comprising:

a roller configured to convey a sheet;

a heating member configured to heat the sheet conveyed by the roller and extending in a width direction orthogonal to a conveyance direction of the sheet;

a first temperature sensor configured to output a signal depending on a temperature of an end region of the heating member in the width direction;

a second temperature sensor configured to output a signal depending on a temperature of a center region of the heating member in the width direction;

a length sensor configured to measure a length of the sheet in the conveyance direction; and a controller electrically connected to the first temperature sensor and the second temperature sensor, the controller configured to selectively execute a first mode and a second mode in a case that the image forming apparatus executes continuous printing in which an image is formed on a second sheet continuously after an image is formed on a first sheet, the first mode being a mode in which the roller conveys the first sheet first, and then conveys the second sheet at a first interval, the second mode being a mode in which the roller conveys the first sheet first, and then conveys the second sheet at a second interval which is longer than the first interval, wherein, when the controller has determined that a first time has elapsed after the image forming apparatus starts the continuous printing in the first mode, and when the controller has determined based on the signal from the first temperature sensor and the signal from the second temperature sensor that a difference between the temperature of the end region of the heating member and the temperature of the center region of the heating member is greater than a first threshold value, the controller is configured to change the mode of the roller from the first mode to the second mode in the continuous printing in which the first mode has been executed, wherein, when the controller has determined based on a signal from the length sensor that the length of the sheet in the conveyance direction is less than a predefined length, when the controller has determined that the first time has elapsed after the image forming apparatus starts the continuous printing in the first mode, and when the controller has determined based on the signal from the first temperature sensor and the signal from the second temperature sensor that the difference between the temperature of the end region of the heating member and the temperature of the center region of the heating member is greater than the first threshold value, the controller is configured to change the mode of the roller from the first mode to the second mode in the continuous printing in which the first mode has been executed, and wherein, when the controller has determined based on the signal from the length sensor that the length of the sheet in the conveyance direction is equal to or more than the predefined length, and when the controller has determined that a second time has elapsed after determining, based on the signal from the first temperature sensor and the signal from the second temperature sensor, that the difference between the temperature of the end region of the heating member and the temperature of the center region of the heating member has reached the first threshold value in executing the first mode, the controller is configured to change the mode of the roller from the first mode to the second mode in the continuous printing in which the first mode has been executed.

11. The image forming apparatus according to claim 10, wherein, when the controller has determined based on the signal from the first temperature sensor and the signal from the second temperature sensor that the difference between the temperature of the end region of the heating member and the temperature of the center region of the heating member is smaller than a third threshold value which is smaller than the first threshold value in executing the second mode, the controller is configured to change the mode of the roller from the second mode to the first mode in the continuous printing in which the second mode has been executed.

12. The image forming apparatus according to claim 10, further comprising:

a tray storing the sheet; and a photosensitive drum including a surface on which a toner image is formed, wherein the roller includes a pickup roller configured to convey the sheet in the tray toward the photosensitive drum.

* * * * *